US006007244A

United States Patent [19]

Dinder

[11] Patent Number: 6,007,244

[45] Date of Patent: Dec. 28, 1999

[54] PLASTIC FILM BAG ASSEMBLY

[75] Inventor: Joseph Dinder, Buffalo, N.Y.

[73] Assignee: Packaging Innovations, Inc., Nashville, Tenn.

[21] Appl. No.: 09/124,131

[22] Filed: Jul. 29, 1998

[51] Int. Cl.[6] ..... B65D 33/14

[52] U.S. Cl. ..... 383/24; 383/9; 383/37; 383/63; 206/554

[58] Field of Search ..... 383/9, 37, 63, 383/22, 23, 24; 206/554

[56] References Cited

U.S. PATENT DOCUMENTS

| | | | |
|---|---|---|---|
| 538,712 | 5/1895 | Stuart . | |
| 981,639 | 1/1911 | Hall . | |
| 1,883,108 | 10/1932 | Thompson | 206/554 X |
| 3,190,490 | 6/1965 | Membrino | 206/554 X |
| 3,312,339 | 4/1964 | Million . | |
| 3,385,428 | 10/1966 | Kugler . | |
| 3,771,645 | 11/1973 | Wendel . | |
| 3,777,930 | 12/1973 | Ericson et al. . | |
| 3,889,871 | 6/1975 | White . | |
| 3,915,302 | 10/1975 | Farrelly et al. . | |
| 3,918,589 | 11/1975 | Nausedas . | |
| 4,046,257 | 9/1977 | Lehmacher . | |
| 4,290,467 | 9/1981 | Schmidt . | |
| 4,305,503 | 12/1981 | Membrino . | |
| 4,406,371 | 9/1983 | Membrino . | |
| 4,458,466 | 7/1984 | Carbone . | |
| 4,485,929 | 12/1984 | Betts, Sr. . | |
| 4,527,693 | 7/1985 | Membrino . | |
| 4,557,384 | 12/1985 | Membrino . | |
| 4,560,068 | 12/1985 | Membrino . | |
| 4,586,319 | 5/1986 | Ausnit . | |
| 4,611,719 | 9/1986 | Dudek et al. . | |
| 4,630,311 | 12/1986 | Bentson . | |
| 4,699,607 | 10/1987 | Lambrecht . | |
| 4,733,780 | 3/1988 | Jensen . | |
| 4,734,148 | 3/1988 | Meyer . | |
| 4,769,126 | 9/1988 | Roen et al. . | |
| 4,846,586 | 7/1989 | Bruno . | |
| 5,033,868 | 7/1991 | Peppiatt . | |
| 5,094,707 | 3/1992 | Bruno . | |
| 5,100,000 | 3/1992 | Huseman . | |
| 5,118,202 | 6/1992 | Bruno . | |
| 5,419,437 | 5/1995 | Huseman | 383/37 X |
| 5,575,393 | 11/1996 | Gebhardt | 383/37 X |
| 5,788,080 | 8/1998 | Sill et al. | 383/37 X |
| 5,851,071 | 12/1998 | Arnell | 383/63 |

FOREIGN PATENT DOCUMENTS

| | | |
|---|---|---|
| 270432 | 4/1964 | Australia . |
| 801563 | 12/1968 | Canada . |
| 850483 | 9/1970 | Canada . |
| 1341587 | 9/1963 | France . |
| 2408831 | 8/1975 | Greece . |

OTHER PUBLICATIONS

Minigrip product information sheet No Date, No Page #.

"Quicksack" literature—one page No Date, No Author.

*Primary Examiner*—Jes F. Pascua

*Attorney, Agent, or Firm*—George Pappas

[57] ABSTRACT

A plastic film bag assembly includes a recloseable plastic film bag made up of a front wall and back wall joined together and having complementary detachably attachable zipper profiles at the bag opening. A lip extends from the front wall above the zipper profiles. A header extends above the back wall above the zipper profiles. A hole is provided through the header at a distance from the header perimeter edge and defining a severable header portion between the hole and the perimeter edge. A slit or perforation may be provided at the severable header portion for controlling the strength thereof. The bags are supported on a stop member which extends through the header holes. The bags are manually individually dispensed by gripping the lip and pulling for at least partially separating the zipper profiles and, thereafter, causing the severable header portion to be severed and thereby causing the bag to be ripped off of the stop member.

32 Claims, 3 Drawing Sheets

PLASTIC FILM BAG ASSEMBLY

TECHNICAL FIELD

The present invention relates to plastic film bags having complementary zipper profiles for selectively opening and closing the bags. More particularly, the present invention relates to recloseable plastic film bags which are supported at a desired location and which are individually manually removed or dispensed from the support structure for use.

BACKGROUND OF THE INVENTION

Recloseable plastic film bags of the type having complementary zipper profiles are today commonly and widely used in various applications for temporarily or semi-permanently storing many different goods such as, for example, foods, electronic equipment, mechanical components, specimens, etc. When recloseable bags are individually used manually for placing products or goods therein, it is desirable for such bags to be provided in packs of large quantities and to easily and readily be individually dispensable therefrom.

An example of recloseable individually dispensable plastic film bags are disclosed in Bruno, U.S. Pat. No. 4,846,586. There, recloseable plastic film bags are provided with a flap attached to the back wall of the bag and extending upwardly therefrom. Holes are formed on the flap for mounting or supporting the bags by receiving a peg therethrough. The bag front wall is provided with a finger flap to enable a user to insert his finger therein and remove an individual bag from the stack on the mounting pegs. Individual bags which are removed from the pegs in this fashion require that the user then first pull the zipper profiles apart and open the bag prior to use. In an alternate embodiment, the bags are provided in an initially open condition with the zipper profiles detached from one another thereby eliminating the cumbersome step of having to open the individual bags after pulling them off of the pegs. Pre-opened bags, however, are undesirable because they are not easily stacked and require substantially more storage space and, further, because prior to their use, the bags could inadvertently become contaminated by something entering or falling into the bag cavity.

Another example of prior recloseable plastic film bags which are supported and individually dispensable are disclosed in Huseman, U.S. Pat. Nos. 5,309,698 and 5,419,437. There, recloseable plastic film bags having interlocking zipper profiles are provided having a header portion extending upwardly from the back wall. The bags are supported by the header. A perforation is provided on the header portion above the zipper profiles and the strength of the perforation is greater than the strength of the zipper profiles such that pulling on the front wall lip first causes the zipper profiles to separate and, thereafter, causes the bag to be separated from its header at the perforation. Typically, the header portions above the perforations are attached together by staples, hot needle/heat welding, or other suitable means. The header portions above the perforations essentially serve only to support the individual bags and, thus, after the bags are ripped or separated therefrom, are either discarded or preferably recycled. Accordingly, although this recloseable bag structure provides bags which are initially closed and which are dispensed in an open condition, the cost of material for manufacturing can be relatively higher in view of the header portion above the perforations which is discarded.

SUMMARY OF THE INVENTION

An object of the present invention is to provide a new and improved individually dispensable and manually useable recloseable plastic film bag or bags which overcome the above-discussed disadvantages and drawbacks associated with prior recloseable plastic film bags.

Another object of the present invention is to provide a new and improved individually dispensable recloseable plastic film bag or bags which are initially at least partially closed and which allow stacking thereof in a compact manner taking up a minimal amount of space and which are, further, relatively lower in material costs.

Briefly, the present invention is directed to a new and improved individually dispensable recloseable plastic film bag formed of a front wall and a back wall which are joined together so as to define a cavity therebetween. At the bag opening leading to the cavity, complementary detachably attachable zipper profiles are provided on the front and back walls thereby allowing the bag to be selectively opened and closed. A lip is attached to the front wall above the front wall zipper profile. A header is provided and attached to the back wall above the back wall zipper profile. One or more holes are provided through the header at a location so as to define a severable header portion between the hole and the header perimeter edge. A stop member extends through the header hole and is adapted to support both the header and the plastic film bag extending therebelow. The hole through the header is located with respect to the header perimeter edge such that the strength of the severable header portion is greater than the strength of the zipper profiles in a manner whereby when the zipper profiles are at least partially attached to one another, pulling on the front wall lip first causes the complementary zipper profiles to at least partially be separated from one another and, thereafter, causes the severable header portion to be severed and ripped off of the stop member. In this fashion, the bag is dispensed in an open condition eliminating the need for the operator to then have to open the bag, for example, by using both hands. Additionally, the header portion extending above the back wall zipper is maintained as small as possible and, further, because the entire header portion is ripped off of the stop member and remains with the bag, no plastic film remains with the stop member for discarding or is otherwise wasted.

In one embodiment, the stop member includes a ring, preferably in the form of a tie wrap, extending through the header holes of a plurality of bags thereby retaining the bags together as a pack. A hook member is also provided and is selectively attachable to a wall. The hook member extends through the ring member thereby supporting the ring and the pack of plastic bags. In an alternate embodiment, the hook member which is selectively attachable to a wall extends through the header holes of a plurality of plastic film bags thereby supporting the bags. In either case, for dispensing an individual bag, an operator merely grasps and pulls the front wall lip causing the complementary zipper profiles to at least partially be separated from one another and, thereafter, causing the severable header portion to be severed for releasing the header and bag from the ring and hook members or merely the hook member. Although a single header hole and stop member can be used generally at the horizontal center of the header, two or more header holes and stop member combinations can be used instead so as to more positively support the plastic film bags prior to dispensing and preventing the bags from pivoting about a single stop member.

The strength of the severable header portion is controlled depending on the plastic film material and thickness thereof by locating the header hole at a certain distance from the header perimeter edge. In this regard, a slit or cut or a perforation may also be provided in the plastic film in the area between the header perimeter edge and hole so as to properly adjust and provide the correct strength thereat as needed. The plastic film bags are made of either a low density or high density plastic film material including, for example, styrene, polyester, polypropylene, polyethylene, or any other synthetic resin or polymeric material.

In one form thereof, the present invention is directed to a plastic film bag assembly including a plastic film bag having a front wall and a back wall joined together and defining a cavity therebetween and an opening leading to the cavity. Complementary detachably attachable zipper profiles are provided on the front and back walls at the bag opening for selectively opening and closing the bag. A header is attached to the back wall. A hole is provided through the header at a distance from a header perimeter edge. A severable header portion is defined between the hole and the perimeter edge. A stop member extends through the header hole. The strength of the severable header portion is greater than the strength of the zipper profiles such that when the zipper profiles are at least partially attached to one another and the stop member is received through the header hole, pulling on the front wall zipper first causes the complementary zipper profiles to at least partially be separated from one another and, thereafter, causes the severable header portion to be severed and ripped off of the stop member.

In one form thereof, the present invention is directed to a plastic film bag assembly including a plastic film bag having a front wall and a back wall joined together and defining a cavity therebetween and an opening leading to the bag cavity. Complementary detachably attachable zipper profiles are provided on the front and back walls at the bag opening for selectively opening and closing the bag. A header is attached to the back wall. A hole extends through the header at a distance from the perimeter edge. A severable header portion is defined between the header hole and the perimeter edge. A stop member is provided and extends through the header hole.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DESCRIPTION OF THE PREFERRED EMBODIMENTS

Figure 1:
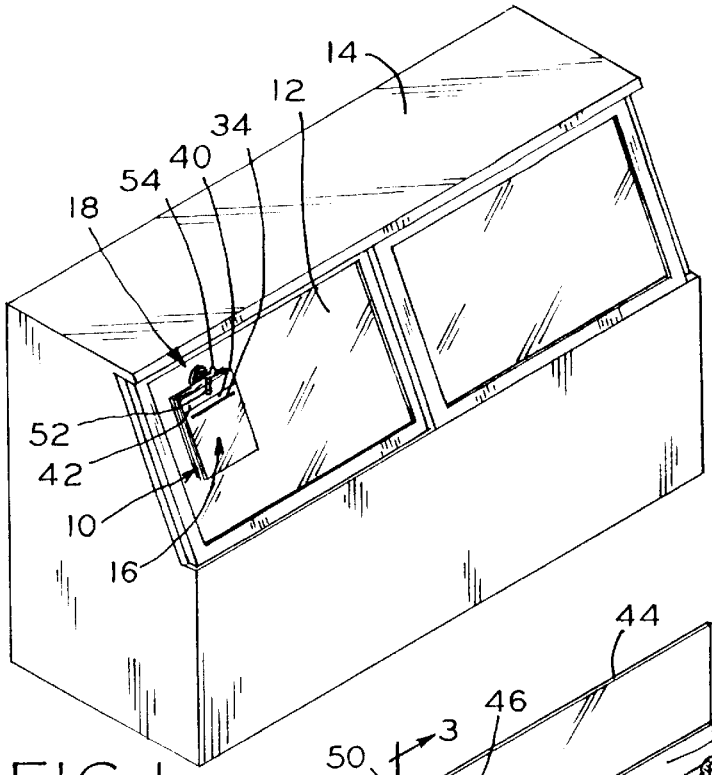
FIG. 1 is a perspective view of a pack of plastic film bags constructed in accordance with the principles of the present invention and supported on a wall of a cooler.

Referring initially to FIG. 1, a plastic film bags assembly is shown and generally depicted by the numeral 10. Plastic film bags assembly 10 is shown supported on a wall depicted herein as a sliding glass door 12 of a freezer or cooler 14. As shown, the assembly 10 includes a plurality of plastic film bags 16 supported on the sliding glass door 12 with a stop member generally depicted by the numeral 18. As more fully discussed hereinbelow, the plastic film bags 16 are selectively manually dispensed or ripped off of the stop member 18 for use by the operator as may be needed or desired.

Figure 2:
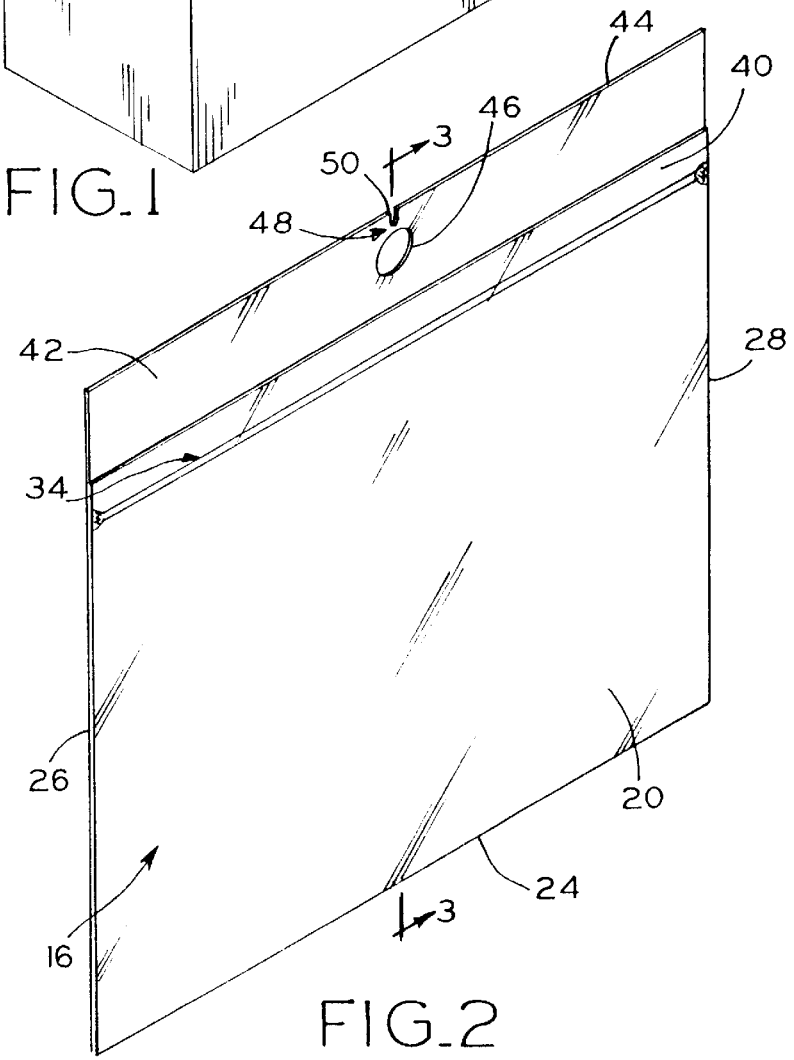
FIG. 2 is a perspective view of a plastic film bag constructed in accordance with the principles of the present invention.
Figure 3:
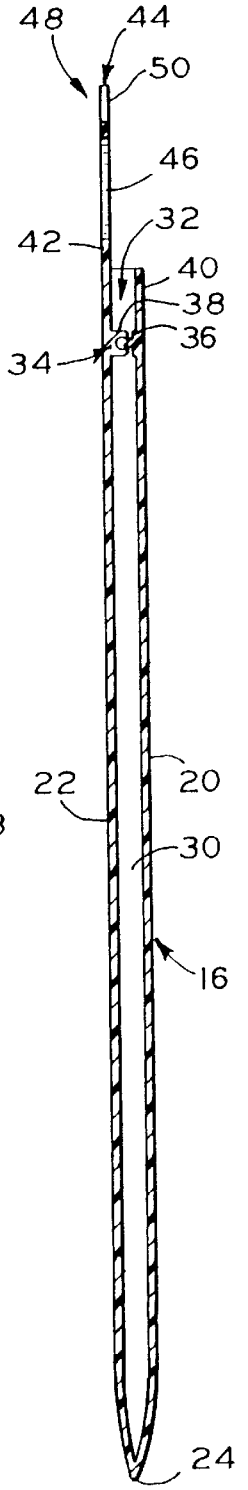
FIG. 3 is a vertical cross sectional view of the plastic film bag shown in FIG. 2 and taken along line 3—3.

As best seen in FIGS. 2 and 3, each of the plastic film bags 16 is made up of and includes a plastic film front wall 20 and a plastic film back wall 22 substantially coplanar with one another and joined together at their lower or bottom edge 24, left edge 26 and right edge 28. Front and back walls 20 and 22 are attached together by heat sealing or other suitable means or, depending on the manufacturing process, may be integral with one another at one or more of the edges or seams while the other edges or seams may be joined by heat sealing or other suitable means. For example, if bag 16 were made from a single ply of plastic material bent at bottom edge 24, the left and right edges 26 and 28 will be joined by heat sealing, while front and back walls 20 and 22 will be integral at the bottom edge 24.

Together, front and back walls 20 and 22 form or otherwise define a cavity or chamber 30 therebetween whereat various items or things can be placed and temporarily or semi-permanently stored. The bag cavity 30 is accessible through an opening 32 located generally at the top of front and back walls 20 and 22 and leading or communicating with the bag cavity 30.

Complementary detachably attachable zipper profiles designated by the numeral 34 are provided on the front and back walls 20 and 22 at the bag opening 32 for selectively opening and closing the bag 16 and gaining access to cavity 30. Complementary zipper profiles 34 include a male zipper profile 36 located on the inside surface of front wall 20 and a female zipper profile 38 located on the inside surface of back wall 22. Male and female zipper profiles 36 and 38 are formed integrally with front and back walls 20 and 22 respectively or, in the alternative, can be formed separately and thereafter adhered or attached to the inside surfaces of the front and back walls 20 and 22. Additionally, the location of the zipper profiles can be reversed such that the male zipper profile is located on the inside surface of back wall 22 and the female zipper profile 38 is located on the front wall 20. As can be appreciated, the male and female zipper profiles 36 and 38 are selectively separated from one another or pushed together and engaged for selectively opening and closing the bag 16 at opening 32.

At the upper end of front wall 20, there is provided or attached a lip 40. Lip 40 is preferably located above complementary zipper profiles 34 as shown and is integrally formed with front wall 20. Lip 40, as further discussed hereinbelow, is provided for selectively grasping and separating the zipper profiles 36 and 38 and severing the bag 16 from the stop member 18.

A header 42 is attached or is integrally formed with back wall 22 and extends upwardly therefrom and above complementary zipper profiles 34. Header 42 includes an upper perimeter edge 44 and a hole 46 cut and extending therethrough. Hole 46 is adapted to receive a stop member 18 therethrough for supporting bag 16 as shown in FIG. 1. A severable header portion 48 is, thus, defined between the hole 46 and the upper perimeter edge 44 whereat the plastic film of header 42 is ripped or otherwise separated for removing the bag 16 from the stop member 18. The strength of the severable header portion 48 is controlled, depending on the type and thickness of the plastic material making up header 42, by shaping the severable header portion and properly locating hole 46 at a certain distance from the perimeter edge 44. To increase the strength of severable header portion 48, hole 46 is located further away from perimeter edge 44 whereas for decreasing the strength of the severable header portion 48, hole 46 is located closer to the perimeter edge 44. Severable header portion 48 is shaped for controlling the strength thereof by, lets for example, cutting a slit 50 starting at the perimeter edge 44 and extending toward hole 46 or by perforating the plastic film at the severable header portion 48 from the perimeter edge 44 to the hole 46. The slit 50 and/or perforation at the severable header portion 48 serves to weaken the strength of the severable header portion 48 in a controlled manner and for enabling manufacturing in a manner whereby the strength of the severable header portion 48 remains relatively constant.

Figure 5:
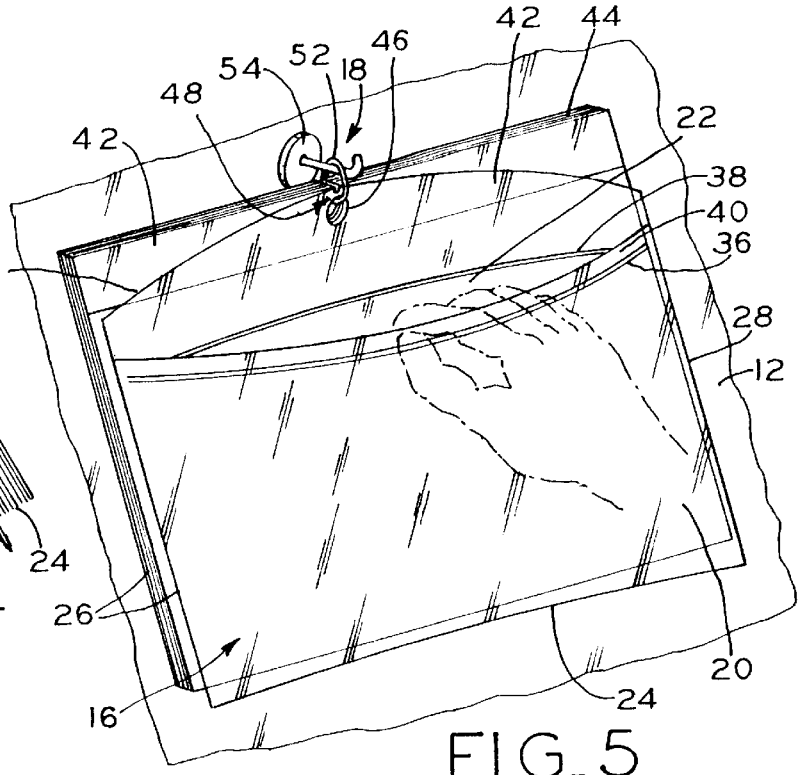
FIG. 5 is a perspective view of the plastic film bags assembly shown in FIG. 1 and showing a plastic film bag after it has been at least partially been opened but prior to severing from the stop member.
Figure 6:
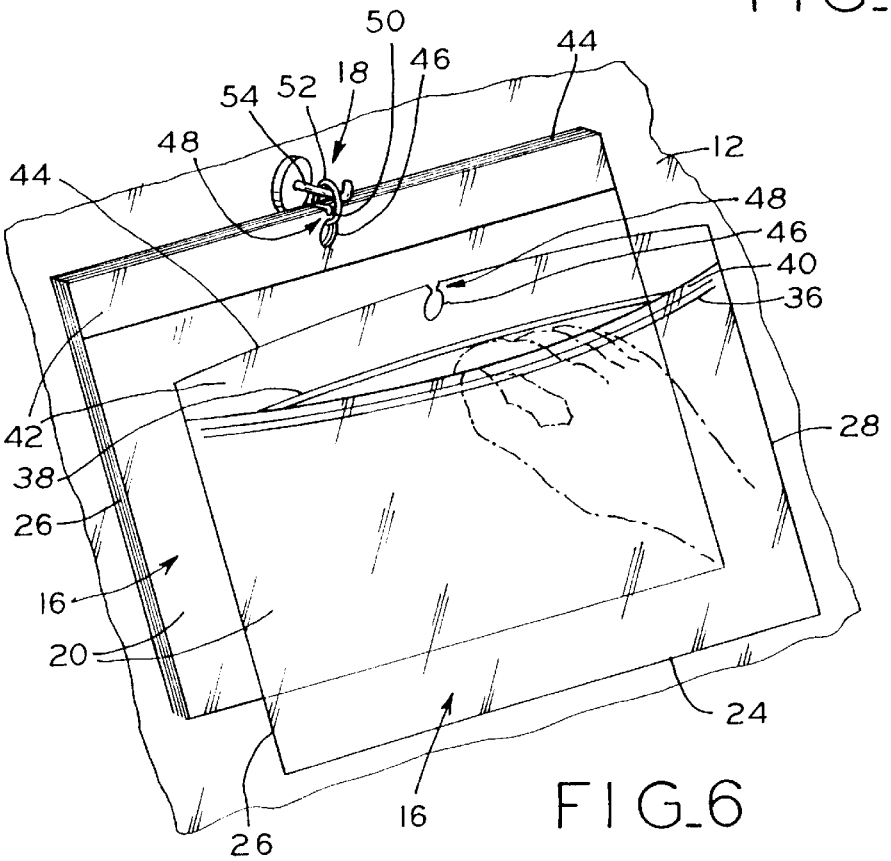
FIG. 6 is a perspective view of the plastic film bag assembly shown in FIG. 5 after the plastic film bag has been fully dispensed or severed away from the stop member.

The strength of the severable header portion 48 is further controlled so as to be greater than the strength of the complementary zipper profiles 34 such that, when the zipper profiles are fully attached to one another as shown in FIG. 3 or at least partially attached to one another, pulling on the lip 40 and, thus, the front wall zipper profile 36 first causes the zipper profiles 36 and 38 to be separated from one another thereby opening the bag 16 without causing the severable header portion 48 to be severed or ripped as shown in FIG. 5. However, further pulling on lip 40 causes the severable header portion 48 to be pulled against the stop member 18 and to be severed or ripped off of the stop member 18 as shown in FIG. 6. As can be appreciated, in this fashion, the operator or user ends up with an opened bag 16 in hand ready to be filled as may be needed or desired.

Figure 4:
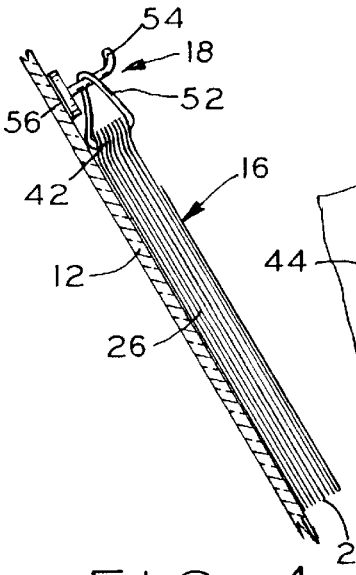
FIG. 4 is a side elevation view of the plastic film bags assembly shown in FIG. 1.

As best seen in FIGS. 4–6, stop member 18 includes a ring 52 preferably in the form of a tie-wrap extending through the holes 46 of a plurality of bags 16. Ring 52 may also be made up of other elongate materials such as rope, wire, etc. Ring 52 is adapted to fit over and be supported on a hook member 54 which is selectively attachable to a wall such as the sliding glass door 12. As shown in FIG. 4, hook member 54 is preferably adhered to glass door 12 via two-way tape or adhesive 56. In this embodiment, a plurality of plastic film bags 16 are stacked and retained together prior to use with ring member 52. For use, the stack of plastic film bags are lifted and ring member 52 is placed over the hook member 54 as shown in FIG. 4 thereby supporting the stack of plastic film bags therebelow. Each of the plastic film bags 16 are, thereafter, individually ripped off or dispensed as described hereinabove and shown in FIGS. 5 and 6, leaving nothing behind except for the ring member 52. After all of the plastic film bags have been dispensed, ring member 52 is merely discarded and another stack of plastic film bags may be hung on the hook member 54 again as shown in FIG. 4.

Figure 8:
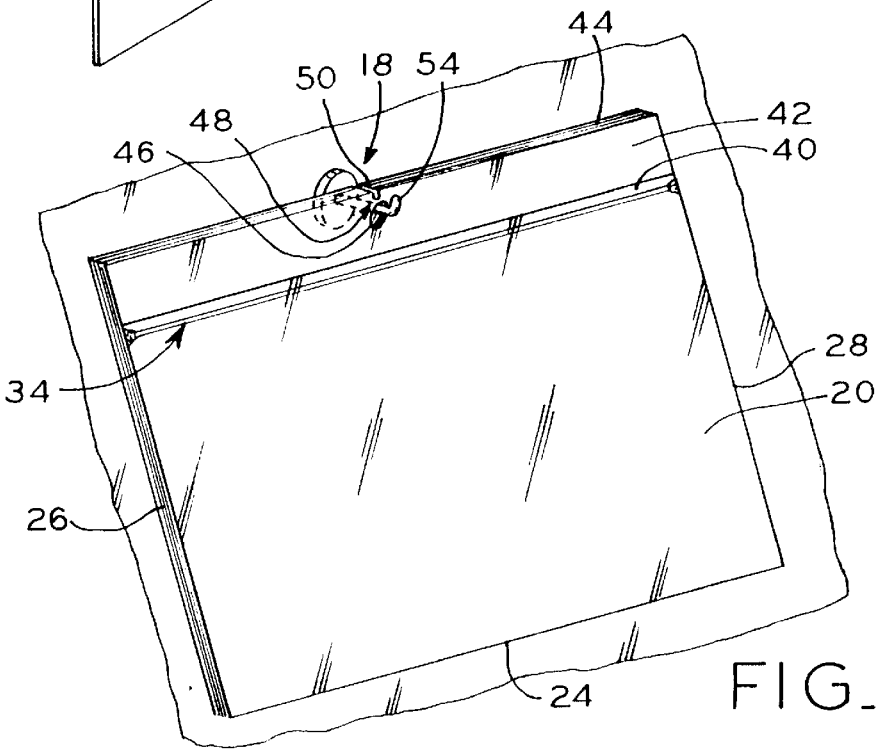

In an alternative embodiment, as shown in FIG. 8, stop member 18 does not utilize a ring member 52 but, rather, only a hook member 54 which extends through the holes 46 of bags 16. In this embodiment, the severable header portion 48 is pulled and forced directly against the hook member 54 for severing the severable header portion 48 and ripping or dispensing an individual bag 16 from the hook member 54. In this embodiment, the cost of a ring member is eliminated, however, it is somewhat more difficult to store a plurality of stacked plastic film bags in their stacked position and to easily hang them onto the hook member 54 as shown in FIG. 8.

Figure 7:
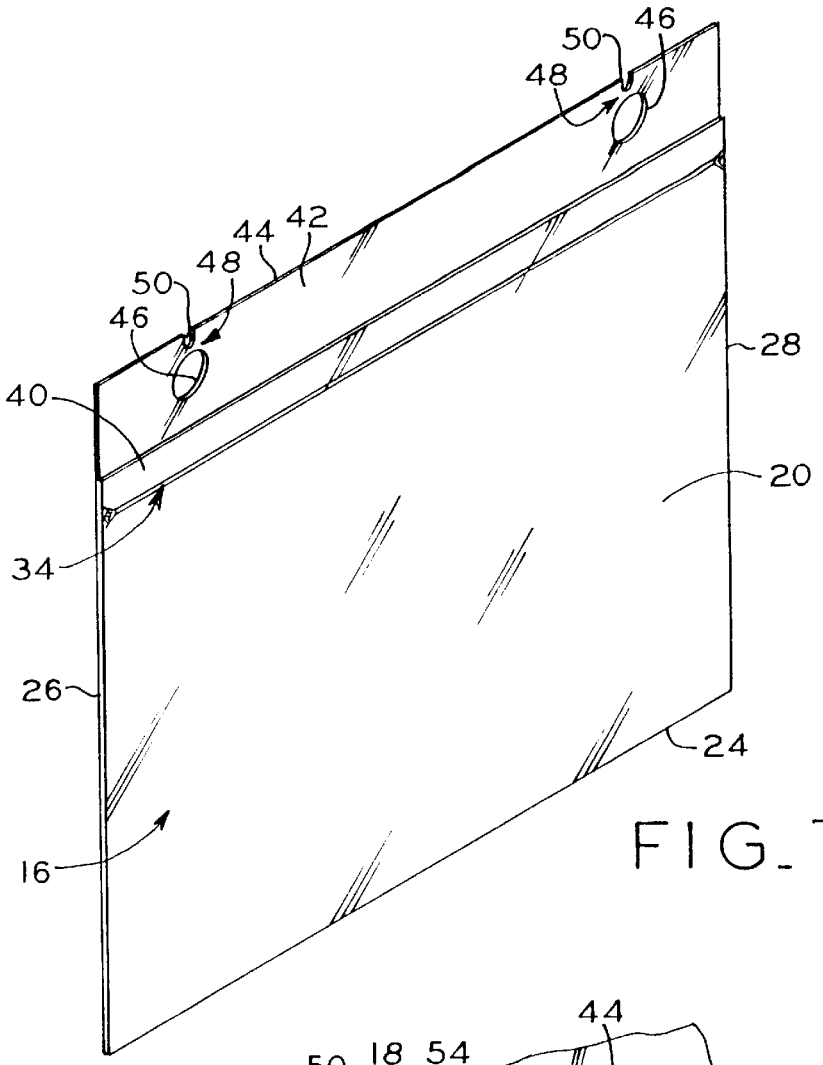
FIG. 7 is a perspective view of an alternate embodiment of a plastic film bag constructed in accordance with the principles of the present invention; and, FIG. 8 is a perspective view of a plastic film bags assembly showing a hook member extending through the plastic film bags header holes.

In yet another embodiment, as shown in FIG. 7, the header 42 is provided with two holes 46 with severable header portions 48 thereabove. In this embodiment, stop members 18 are provided at each of the holes 46 similar to that shown and described hereinabove. As can be appreciated, this further stabilizes the bags 16 and retains them in the horizontal position in view of the two holes 46 and stop members 18. This essentially prevents possible pivotal motion of the bags 16 about the stop member 18 which is possible in the embodiment shown in FIGS. 5 and 6.

Plastic film bags 16 are made of a thin plastic film of polyethylene or synthetic resin of a low density or high density type and which is typically generally translucent. As used herein, the terms "attached" and "joined" are intended to mean and include not only structure such as one plastic body brought together with another plastic body and adhered together by, for example, heat sealing or welding, but also wherein one plastic body is integrally formed with another plastic body.

While this invention has been described as having specific embodiment, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A plastic film bag assembly comprising:

a plastic film bag including a front wall and a back wall joined together and defining a cavity therebetween and an opening leading to said cavity;

complementary detachably attachable zipper profiles on said front and back walls at said bag opening for selectively opening and closing the bag;

a header extending from said back wall, said header having a hole therethrough and a perimeter edge, a severable header portion defined between said hole and said perimeter edge; and, a ring extending through said header hole.

2. The plastic film bag assembly of claim 1 further comprising a hook member selectively attachable to a wall, said hook member extending through said ring for supporting said ring and plastic bag.

3. The plastic film bag assembly of claim 2 further comprising a lip extending from said front wall, said lip being selectively grasped and pulled for severing said plastic film bag and header from said ring.

4. The plastic film bag assembly of claim 1 wherein said severable header portion includes a perforation.

5. The plastic film bag assembly of claim 4 further comprising a hook member selectively attachable to a wall, said hook member extending through said ring for supporting said ring and plastic bag.

6. The plastic film bag assembly of claim 4 further comprising a lip extending from said front wall, said lip being selectively grasped and pulled for severing said plastic film bag and header from said ring.

7. The plastic film bag assembly of claim 1 wherein said severable header portion comprises a slit cut.

8. The plastic film bag assembly of claim 7 further comprising a lip extending from said front wall, said lip being selectively grasped and pulled for severing said plastic film bag and header from said ring.

9. The plastic film bag assembly of claim 7 further comprising a hook member selectively attachable to a wall, said hook member extending through said ring for supporting said ring and plastic bag.

10. The plastic film bag assembly of claim 1 further comprising a lip extending from said front wall, said lip being selectively grasped and pulled for severing said plastic film bag and header from said ring.

11. A plastic film bag assembly comprising:

a plastic film bag including a front wall and a back wall joined together and defining a cavity therebetween and an opening leading to said cavity;

complementary detachably attachable zipper profiles on said front and back walls at said bag opening for selectively opening and closing the bag;

a header extending from said back wall, said header having a hole therethrough and a perimeter edge, a severable header portion defined between said hole and said perimeter edge;

a ring extending through said header hole; and, wherein the strength required to tear said severable header portion is greater than the strength required to at least partially separate said zipper profiles such that when said zipper profiles are at least partially attached to one another, pulling on said front wall zipper first causes said complementary zipper profiles to at least partially be separated from one another and, thereafter, causes said severable header portion to be severed and thereby ripped off of said ring.

12. The plastic film bag assembly of claim 11 wherein said severable header portion comprises a slit cut.

13. The plastic film bag assembly of claim 12 further comprising a lip extending from said front wall, said lip being selectively grasped and pulled for opening and severing said plastic film bag and header from said ring.

14. The plastic film bag assembly of claim 13 further comprising a hook member selectively attachable to a wall, said hook member extending through said ring for supporting said ring and plastic bag.

15. The plastic film bag assembly of claim 14 wherein said plastic film bag is made of high density polyethylene plastic.

16. The plastic film bag assembly of claim 14 wherein said plastic film bag is made of low density polyethylene plastic.

17. The plastic film bag assembly of claim 11 further comprising a lip extending from said front wall, said lip being selectively grasped and pulled for opening and severing said plastic film bag and header from said ring.

18. The plastic film bag assembly of claim 17 further comprising a hook member selectively attachable to a wall, said hook member extending through said ring for supporting said ring and plastic bag.

19. The plastic film bag assembly of claim 11 further comprising a hook member selectively attachable to a wall, said hook member extending through said ring for supporting said ring and plastic bag.

20. The plastic film bag assembly of claim 19 wherein said severable header portion comprises a slit cut.

21. The plastic film bag assembly of claim 20 further comprising a lip extending from said front wall, said lip being selectively grasped and pulled for opening and severing said plastic film bag and header from said ring.

22. The plastic film bag assembly of claim 11 wherein said severable header portion includes a perforation.

23. The plastic film bag assembly of claim 11 wherein said plastic film bag is made of high density polyethylene plastic.

24. The plastic film bag assembly of claim 11 wherein said plastic film bag is made of low density polyethylene plastic.

25. A plastic film bag assembly comprising:

a plastic film bag including a front wall and a back wall joined together and defining a cavity therebetween and an opening leading to said cavity;

complementary detachably attachable zipper profiles on said front and back walls at said bag opening for selectively opening and closing the bag;

a header extending from said back wall, said header having a hole therethrough and a perimeter edge, a severable header portion defined between said hole and said perimeter edge;

a ring extending through said header hole; and, wherein said severable header portion comprises a slit cut.

26. The plastic film bag assembly of claim 25 further comprising a lip extending from said front wall, said lip being selectively grasped and pulled for opening and severing said plastic film bag and header from said stop member.

27. The plastic film bag assembly of claim 26 wherein said stop member comprises a hook member selectively attachable to a wall and extending through said header hole.

28. The plastic film bag assembly of claim 25 wherein said stop member comprises a hook member selectively attachable to a wall and extending through said header hole.

29. A plastic film bag assembly comprising:

a plastic film bag including a front wall and a back wall joined together and defining a cavity therebetween and an opening leading to said cavity;

complementary detachably attachable zipper profiles on said front and back walls at said bag opening for selectively opening and closing the bag;

a header extending from said back wall, said header having a hole therethrough and a perimeter edge, a severable header portion defined between said hole and said perimeter edge;

a ring extending through said header hole; and, wherein said severable header portion includes a perforation.

30. The plastic film bag assembly of claim 29 wherein said stop member comprises a hook member selectively attachable to a wall and extending through said header hole.

31. The plastic film bag assembly of claim 29 further comprising a lip extending from said front wall, said lip being selectively grasped and pulled for opening and severing said plastic film bag and header from said stop member.

32. The plastic film bag assembly of claim 31 wherein said stop member comprises a hook member selectively attachable to a wall and extending through said header hole.

* * * * *